United States Patent [19]

Hill

[11] 4,415,267

[45] Nov. 15, 1983

[54] APPARATUS FOR MIXING AND APPLICATION OF PAVING COMPOSITIONS

[76] Inventor: Francis K. Hill, P.O. Box 2059, Wickenburg, Ariz. 85358

[21] Appl. No.: 384,577

[22] Filed: Jun. 3, 1982

[51] Int. Cl.[3] ..... B28C 5/00; B28C 5/38

[52] U.S. Cl. ..... 366/14; 366/22; 366/28; 366/34; 366/51; 366/65; 366/137; 366/165; 366/338

[58] Field of Search ..... 366/14, 15, 22, 23, 366/24, 28, 29, 34, 40, 51, 65, 136, 137, 165, 290, 338

[56] References Cited

U.S. PATENT DOCUMENTS

| | | | |
|---|---|---|---|
| 1,789,320 | 1/1931 | Overbury | 366/290 X |
| 2,915,412 | 12/1959 | Lyons | 366/29 X |
| 3,231,245 | 1/1966 | Harvey | 366/51 X |
| 3,610,588 | 10/1971 | Diefenbach | 366/24 |
| 3,669,414 | 6/1972 | Love | 366/290 |
| 4,159,877 | 7/1979 | Jacobson et al. | 366/22 |
| 4,322,167 | 3/1982 | Hill | 366/14 X |

*Primary Examiner*—Philip R. Coe

*Attorney, Agent, or Firm*—Herbert E. Haynes, Jr.

[57] ABSTRACT

An apparatus for mixing an additive with molten paving material and for application of the resultant paving composition. The apparatus includes a mixing mechanism in heat transfer relationship with a heated materials tank for recirculatingly moving molten asphalt from the materials tank through the mixing mechanism and back to the materials tank with the additive being added and mixed with the recirculating molten paving material for production of the resulting paving composition which is subsequently supplied from the heated materials tank to an applicator device of the apparatus.

16 Claims, 7 Drawing Figures

APPARATUS FOR MIXING AND APPLICATION OF PAVING COMPOSITIONS

BACKGROUND OF THE INVENTION

1. Field of the Invention

This invention relates generally to pavement materials handling mechanisms and more particularly to an apparatus for mixing and application of paving compositions.

2. Description of the Prior Art

The increased volume of traffic along with general aging has caused severe problems on many roadways, streets, and other paved surfaces. A particular problem results from elastic type failures in pavements which cause cracking patterns of the type sometimes referred to as an "alligator" cracking pattern. This type of elastic failure is caused by fatigue of the pavement surface resulting from repeated deflections. Other problems of concern are random cracking of paved surfaces due primarily from expansion and contraction, and the general aging of the sealing materials in expansion joints. All of these types of pavement failures must be repaired in order to prevent water and/or uncompressible materials from entering into the cracks or joints. If water enters into such cracks or joints it can either wash out the base materials, or cause a general breaking up of the pavement due to freezing. If uncompressible materials, such as sand, enter into the cracks or joints it will severely restrict expansion of the pavement and again result in general breaking up of the pavement surface.

Considerable experimentation has been conducted in recent times to provide relatively low cost repair techniques, and of particular interest, among other specialized pavement compositions, is an asphalt-rubber composition which has proven to be a very satisfactory material for use as a real coating, for filling and sealing random cracks, and as a replacement for deteriorated materials in expansion joints, and the like.

Briefly, the asphalt-rubber composition is a reaction product which is neither asphalt nor rubber in nature but is an elastomeric sealing compound. The asphalt-rubber composition includes a mixture of paving grade asphalt and granulated crumb rubber of the non-oil resistant asphalt-soluble type, which are prepared and mixed in conformity to a specific method and mixture proportions. The asphalt is heated to a range of between 350° F. to 500° F. and the granulated rubber is added and mixed therewith. Although the mix proportions may vary somewhat, it has been found that mix proportions of between 2 and 3 parts of asphalt and one part of rubber are satisfactory and that a mix proportion of 75% plus or minus 2% of asphalt by weight and 25% plus or minus 2% of rubber provides the ideal composition which possesses an ideal balance between the sealing characteristics of the asphalt and the elasticity of the rubber. This particular asphalt-rubber composition is fully disclosed in U.S. Pat. No. 3,891,585 issued on June 24, 1975 to Charles H. McDonald.

Although the asphalt-rubber composition is an excellent material, its more widespread usage has been held back by problems with handling and mixing of the asphalt and rubber materials.

The asphalt material is normally delivered in a molten state to the mixing site such as in heated transport trucks and in general will not pose any particular problems in addition to the well known and expected difficulties associated in the handling of such material. The rubber generally used for this purpose is obtained from a supplier who grinds up old automobile tires and packages the granulated crumb rubber in bags of predetermined weight for shipment to the mixing site.

Although the molten asphalt and rubber materials must be watched to some extent from a quality control standpoint, the inherent characteristics of those materials pose the biggest problems, in that it is very difficult to mix those materials and produce a consistently blended mixture of the proper proportions. The granulated rubber is a somewhat cohesive material and as such will often form clods that block supply conduits, applicator devices, and the like. In addition, the rubber has a tendency to float and avoid mixing with the molten asphalt.

In general, the prior art practice for mixing the asphalt and rubber materials includes pumping the molten asphalt through a suitable flow meter into a mixing tank and manually adding the appropriate number of bags of granulated rubber thereto. The flow meter is used to control the amount of asphalt that is pumped into the mixing tank, and the amount of rubber is controlled by counting the number of pre-weighed bags of rubber that are added to the tank.

The prior art mixing tanks, although varying somewhat in configuration, are all basically the same. Briefly, the mixing tanks are elongated horizontally disposed structures with some sort of an agitation device, such as an auger arrangement which extends longitudinally through the bottom of the tank. The asphalt and rubber materials are introduced into the mixing tank through suitable ports and conduits located at the top thereof, and the mixed asphalt-rubber composition exits the tank by means of a pump and conduit arrangement located at the bottom of the tank. A typical prior art mixing structure of the above described type is fully shown and described in U.S. Pat. No. 3,610,588 issued on Oct. 5, 1971 to G. W. Diefenbach.

The above described prior art mixing mechanism has proven less than satisfactory for several reasons. For example, the prior art mixing apparatus will not always break up the lumps or clods of granulated rubber and this can cause plugging of the conduits and applicator devices. Further, the most troublesome problem with the prior art method and apparatus is that the produced asphalt-rubber composition is not always a consistently blended mixture of proper mix proportions.

As previously mentioned, the granulated rubber has a tendency to float and avoid mixing with the molten asphalt, and therefore, the upper portion of the materials within the tank will have a somewhat larger concentration of rubber than the materials in the lower part of the tank. During draining, the mixture having a lower rubber concentration will be pumped out faster and easier than that having a high concentration of rubber. Since the asphalt-rubber composition is pumped out of the bottom of the mixing tank, the floating rubber will coat the interior of the tank, and the residual composition remaining in the tank after draining, will have a high rubber concentration. It is very rare for a mixing tank to be used for mixing a single batch of the asphalt-rubber composition in that production and/or job requirements most often require very large quantities of the composition.

The above described coating of the tank and residual concentrations will have a cumulative effect and it has been estimated that rubber concentrations will reach between 30% and 35% near the end of a day's continuous mixing tank usage, and this, of course, can cause serious problems with the integrity of the asphalt-rubber composition.

The inadequacy of these prior art mixing devices has spurred the development of highly specialized and very sophisticated mixing vehicles which are transported to job sites and are used solely for mixing the asphalt and rubber with the resulting compositions being pumped from the special mixing equipment into application vehicles. An example of such equipment is fully disclosed in U.S. Pat. No. 4,322,167, issued on Mar. 30, 1982, to F. K. Hill. Although this special mixing device does an excellent job of mixing the asphalt-rubber, it is a very expensive piece of equipment which, when coupled to the transporting costs, the time involved in transfering the mixed materials to applicator devices, and the like, results in it being difficult to economically justify its use in medium and relatively small jobs, an its use will sometimes strain the budgeted allotment for even very large highway repair projects.

Therefore, a need exists for a new and improved apparatus for mixing and application of paving material compositions in general and asphalt-rubber compositions in particular, with the apparatus overcoming some of the problems and shortcomings of the prior art.

SUMMARY OF THE INVENTION

In accordance with the present invention, a new and improved apparatus is disclosed for mixing paving compositions in general and asphalt-rubber pavement compositions in particular, and for the application of same.

The special mixing apparatus is intended to be an integral part of any of the well known application vehicles which are commonly used in applying molten asphalt compositions on paved surfaces for repair and/or maintenance purposes, or otherwise dispensing such materials. One example of such a vehicle is disclosed in U.S. Pat. No. 4,274,586 with the vehicle discussed therein being referred to in the trade as a "spreader truck." A spreader truck is used to apply a spray seal coating on paved surfaces. Another example of such vehicles is fully disclosed in U.S. Pat. No. 4,159,877 with that vehicle being commonly referred to as a "crack sealer." A crack sealer is employed for inserting filler into random cracks and expansion joints in paved surfaces.

The apparatus of the present invention includes an applicator vehicle having a materials containment tank with heating means therein, a mixing mechanism associated in heat transfer relationship with the materials tank and a particular arrangement of conduits, valves and pumps to provide various supply, circulation and output functions of the apparatus.

The materials tank is a relatively large structure for containing the materials that are to be applied to the paved surface by the application vehicle, and the materials tank includes the heating means which provide and/or maintain the needed temperature of the materials contained therein and of the mixing mechanism which is associated in heat transfer relationship with the materials tank. One of the functions of the conduit, valve and pump arrangement of the apparatus is to receive molten asphalt from an external source, such as from an asphalt transport truck, prior to the mixing operation and direct the received asphalt into the materials tank.

The mixing mechanism includes a mixing tank which is associated with the materials tank and is disposed to receive the molten asphalt from the materials tank so that it will flow through the mixing tank with the granulated rubber being added to the flowing asphalt through an openable cover provided on the mixing tank. The mixing tank is provided with means for mixing the granulated rubber with the molten asphalt to produce at least a partially, or pre-mixed asphalt-rubber composition.

The partially mixed asphalt-rubber composition exits the mixing tank and is pumped to the inlet end of a static, or motionless, mixing device. The static mixer, which is integral with and located within the materials tank for temperature control purposes, completes the mixing of the molten asphalt and granulated rubber to produce a completely reacted and homogeneous composition which empties from the outlet end of the static mixer directly back into the materials tank. The contents of the materials tank are recirculated through the mixing mechanism in the above described manner until such time as the desired amount of granulated rubber has been added to the molten asphalt.

When the mixing operation is completed, the homogeneous asphalt-rubber composition may, by means of the conduit, valve and pump arrangement, be recirculated for agitation and temperature control purposes or may be pumped directly to the applicator device of the application vehicle.

In the preferred embodiment, the mixing tank is configured with a tangentially disposed molten asphalt input port adjacent its upper end which augments the natural tendency of the liquid to move in a downwardly spiraling, or vortex, flow path toward the materials output port provided at the bottom of the mixing tank. It has been found by experimentation that this augmented swirling flow of the molten asphalt is sufficient to provide the desired amount of preliminary, or premixing, with the mixing being completed in the static mixer of the mixing mechanism. In a second embodiment, the preliminary mixing may be accomplished by the vortex flow with the completed mixing being accomplished by providing the mixing tank with a suitable type of power driven agitator means.

Accordingly, it is an object of the present invention to provide a new and improved apparatus for the mixing and application of pavement compositions.

Another object of the present invention is to provide a new and improved apparatus for the mixing and application of paving compositions which is particularly well suited for mixing granulated rubber and molten asphalt to produce a completely reacted homogeneous asphalt-rubber composition.

Another object of the present invention is to provide a new and improved pavement composition mixing and application apparatus of the above described type which includes a mixing mechanism which is associated in heat transfer relationship with a heated materials containment tank.

Another object of the present invention is to provide a new and improved pavement composition mixing and application apparatus of the above described character wherein the mixing mechanism includes a mixing tank for receiving the constituents of the pavement composition and providing a preliminary mixture which is supplied to a static mixture which produces a completely reacted homogeneous pavement composition.

Another object of the present invention is to provide a new and improved pavement composition mixing and application apparatus of the above described character wherein the mixing mechanism includes a mixing tank which has means for accomplishing preliminary and complete mixing of the constituents therein to produce a completely reacted homogeneous pavement composition.

Another object of the present invention is to provide a new and improved pavement composition mixing and application apparatus of the above described type wherein a conduit, valve and pump arrangement is associated with the mixing mechanism to accomplish various supply, circulation and output functions of the apparatus.

The foregoing and other objects of the present invention, as well as the invention itself, may be more fully understood from the following description when read in conjunction with the accompanying drawings.

DESCRIPTION OF THE PREFERRED EMBODIMENTS

The primary purpose of the apparatus of the present invention is for the mixing of granulated rubber and molten paving grade asphalt to produce a completely reacted homogeneous asphalt-rubber composition and for application of that end product. Thus, the following description will refer to those components and the desired end product, but it will be understood that this is not intended as a limitation of the present invention in that the apparatus can be employed to mix other additives with molten paving material for the production of other paving compositions and for the application thereof.

Figure 1:
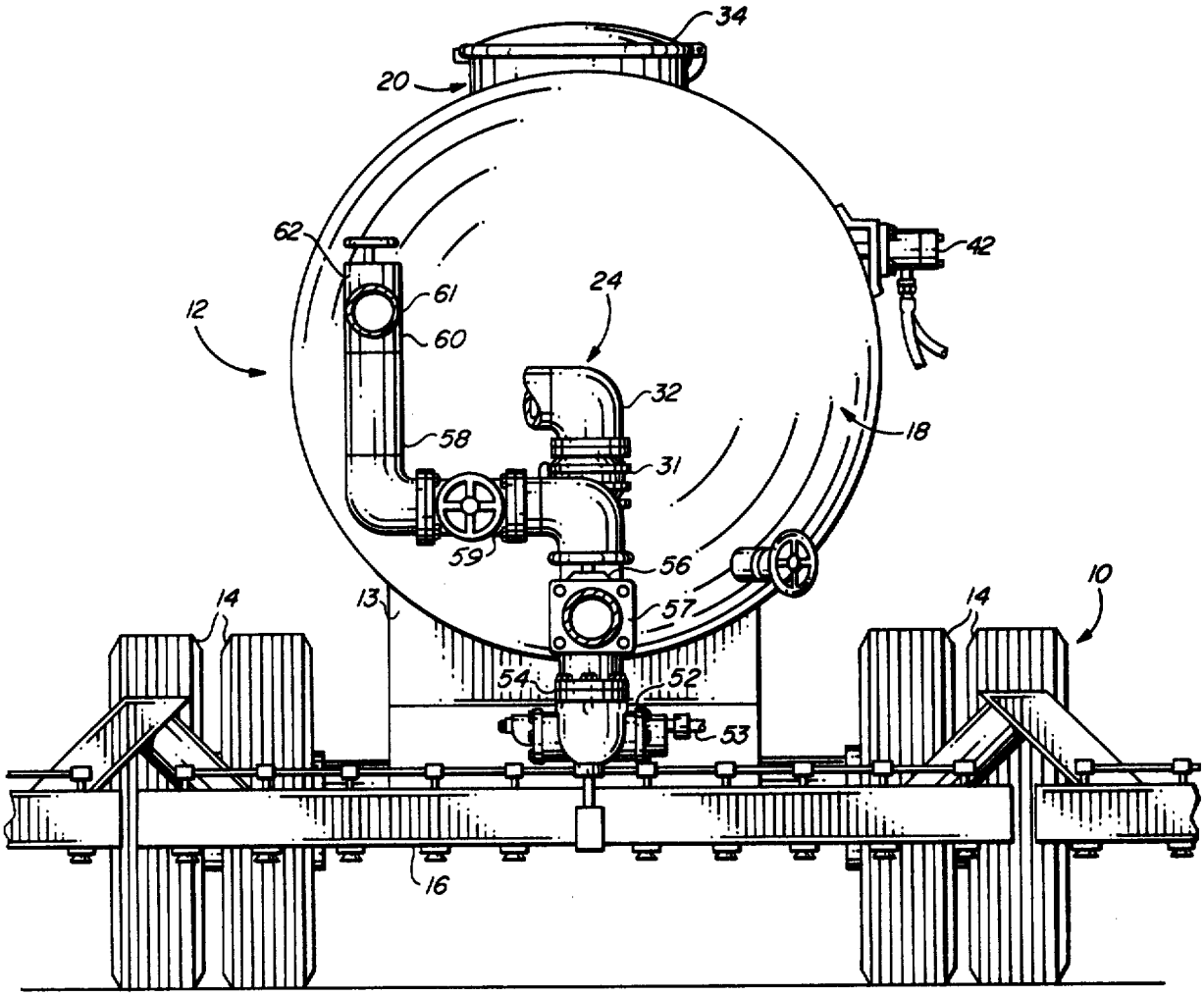
FIG. 1 is a rear elevational view showing the various features of a first embodiment of the apparatus of the present invention.

Referring more particularly to the drawings, FIG. 1 shows a type of asphalt applicator vehicle 10 generally known in the art as a spreader truck, with that vehicle including a special mixing apparatus in accordance with the present invention which is indicated generally by the reference numeral 12. As is well known, a spreader truck is employed for spray application of an asphalt seal coating on paved surfaces for repair and/or maintenance purposes. Such a vehicle is typically provided with a suitable frame 13, wheels 14, and a spray bar mechanism 16 which is the applicator device of the vehicle. As is customary, a prior art spreader truck is also provided with a materials tank, flow control valves, pumps, conduits, power supply devices, heaters, and the like, all of which are needed to accomplish the proper functions of such a vehicle. When a spreader truck is equipped with the mixing apparatus 12 in accordance with the principles of the present invention, the mixing apparatus 12 utilizes some of the usual equipment of the truck and replaces some of that equipment as will become apparent as this description progresses.

As seen best in FIG. 2, and as will hereinafter be described in detail, the special mixing apparatus 12 includes a materials tank 18, a special mixing mechanism formed by the combination of a mixing tank 20 and a static, or motionless, mixer 22, and a conduit, valve and pumping assembly which is indicated generally by the reference numeral 24.

The materials tank 18 is an elongated horizontally disposed cylindrical structure for containment of the materials to be spread on paved surfaces by the application vehicle, and as is customary, the tank 18 is provided with a heater means 26 which provides and/or maintains the required temperature of the materials contained therein. The materials tank 18 is provided with a port 27 adjacent the bottom thereof which is in communication with a shutoff valve 28 mounted on one branch of a tee-fitting 30. Another branch of that same tee-fitting 30 is in communication with another shutoff valve 32 having a conduit 32 extending therefrom. The conduit 32 is employed to receive molten asphalt under pressure from an external source thereof, such as from an asphalt transport truck (not shown), and direct the received molten asphalt through the open valves 28 and 31 into the interior of the materials tank 18. The materials tank 18 is sized to contain a known amount of molten asphalt and that amount will result in the materials tank being filled to the approximate level shown in FIG. 2.

Figure 3:
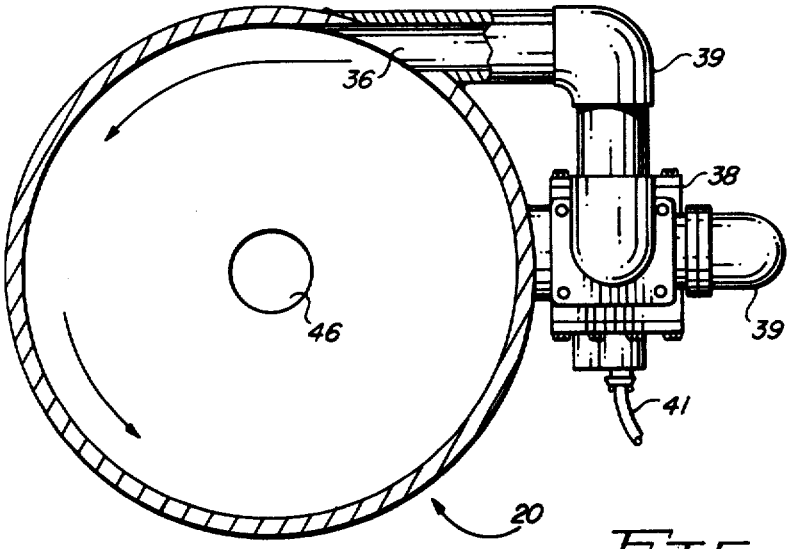
FIG. 3 is a sectional view taken along the line 3—3 of FIG. 2.

In the preferred embodiment, the mixing tank 20 is integrally attached, such as by welding, to the materials tank 18 so as to depend therefrom into the interior of the materials tank 18. The mixing tank 20 is a vertically oriented cylindrical structure having an open top which extends exteriorly from the top of the materials tank 18 and a suitable cover 34 is hingedly mounted on the upper end of the mixing tank 20. The mixing tank 20 is provided with a molten asphalt input port 36 which, as seen best in FIG. 3, is tangentially disposed with respect to the tank 20 adjacent the top thereof. A suitable pump 38 of any well known type suitable for use in pumping molten asphalt is provided in the molten asphalt input conduit 39 the delivery end of which is coupled to the input port 36 of the mixing tank with the other, or inlet, end 40 being open and located adjacent the bottom of the materials tank 18. The pump 38 may be mounted as shown on the exterior of the mixing tank 20, or in any other suitable location, and is provided with the usual drive shaft 41 which is driven, for example, by a hydraulic motor 42 carried on the peripheral surface of the materials tank 18 as shown in FIG. 1.

The asphalt pump 38 mounted in the input conduit 39 is employed to extract the molten asphalt from the interior of the materials tank 18 and direct it under pressure through the tangential input port 36 into the interior of the mixing tank 20. Although the asphalt pump 38 and input conduit 39 constitute the preferred means for directing the molten asphalt from the materials tank 18 into the mixing tank 20, it has been found that the mixing apparatus 12 will function quite satisfactory under most conditions without the pump and conduit 39. As seen in FIG. 2, the molten asphalt input port 36 is located on the mixing tank 20 so as to be below the level of the molten asphalt when the materials tank 18 is full. Thus, molten asphalt will naturally flow into the mixing tank 20, and by providing an open relatively short length of conduit on the input port 36, in the manner shown at 44 in FIG. 5, the desired tangential flow of molten asphalt into the mixing tank will be achieved for reasons which will hereinafter be described in detail. This alternate method for directing molten asphalt into the mixing tank 20 will only work when the mixing apparatus 12 is being employed to mix a full batch of the asphalt-rubber composition. Therefore, the hereinbefore described asphalt input pump 38 provided in the conduit 39 is the preferred embodiment.

The mixing tank 20 is provided with an outlet port 46 at its bottom end and the inlet end of a shutoff valve 48 is coupled to that port. The outlet end of the shutoff valve 48 is connected by means of a conduit 49 to a tee-fitting 50 one branch of which is connected to the third branch of the previously mentioned tee-fitting 30 and the other branch of the tee-fitting 50 is coupled to the inlet port 51 of an asphalt pump 52. The asphalt pump 52 has the usual drive shaft 53, which may be driven by any suitable power means (not shown) provided on the application vehicle 10. The output port 54 of the asphalt pump 52 is connected to a tee-fitting 55 which has one of its branches connected through a shutoff valve 56 to a conduit 57 which is used for reasons which will hereinafter be described in detail. The other branch of the tee-fitting 55 is connected to a conduit assembly 58 through another shutoff valve 59 and the conduit assembly 58 is connected to another tee-fitting 60. One of the branches of the tee-fitting 60 has a conduit 61 connected thereto, for reasons which will hereinafter be described in detail, and the other branch of the tee-fitting 60 is coupled to an adjustable pressure valve 62 which is mounted on the inlet end 63 of the static mixer 22.

With the valves 48 and 59 open, valves 28, 31 and 56 closed and the pumps 38 and 52 operating, the mixing apparatus 12 will be in its mixing operational mode and molten asphalt will flow into the mixing tank 20 through the inlet port 36 and will exit therefrom through the outlet port 46. As is known, liquid flowing in such a manner will inherently flow in a downwardly spiraling motion, or vortex, and this natural flow path is augmented by the tangential disposition of the inlet port 36.

Granulated crumb rubber, which is normally packaged in bags of predetermined weight, is added to the vortex flow of molten asphalt through the top of the mixing tank 20. With the cover 34 open, the bags of rubber are torn open one at a time and emptied into the mixing tank 20. In this manner, the rubber is added gradually to the molten asphalt. It has been found that the turbulence provided by the vortex flow of molten asphalt in the mixing tank 20 is sufficient to provide a preliminary, or premixing of the asphalt and rubber, and the temperture induced reaction of those constituents commences in the mixing tank 20.

The premixed asphalt-rubber composition exits the mixing tank through the open valve 48 and the conduit 49 and is supplied under pressure by the pump 52 through the open valve 59, conduit assembly 58, tee-fitting 60 and the pressure valve 62 to the inlet end of the static mixer 22. The pressure valve 62 is a normally closed device which is adjustably set to automatically open when pressure in the line goes above the predetermined pressure setting of the valve. The purpose of the pressure valve 62 will hereinafter be described in detail, however, it will be noted that the pressure setting of the valve is well below the rated output of the asphalt pump 52. Thus, in the mixing operational mode of the mixing apparatus 12, the premixed asphalt-rubber composition will flow freely into the static mixer 22.

Figure 2:
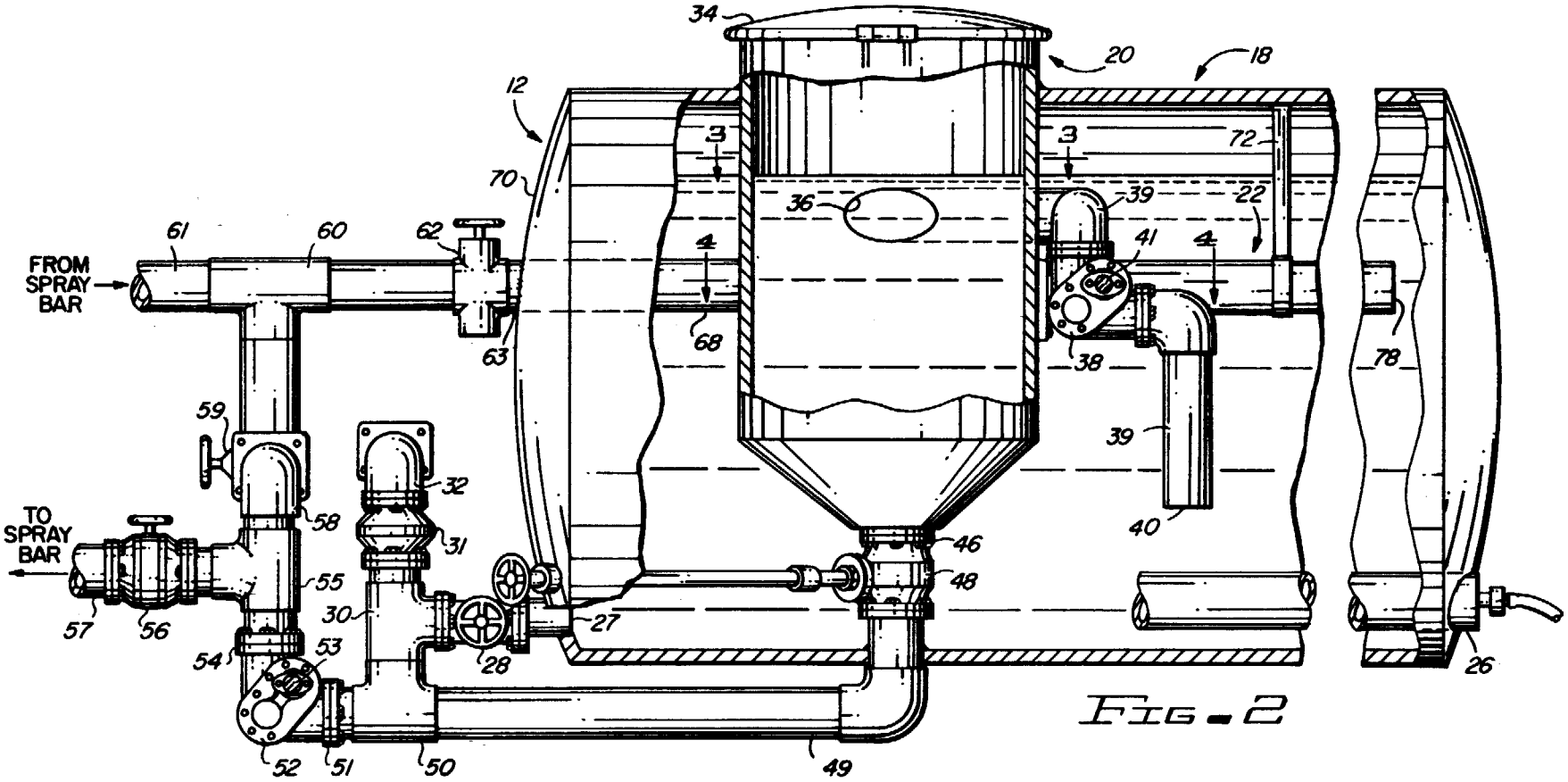
FIG. 2 is a fragmentary side elevational view of the apparatus shown in FIG. 1 and partially broken away to show the various features thereof.
Figure 4:
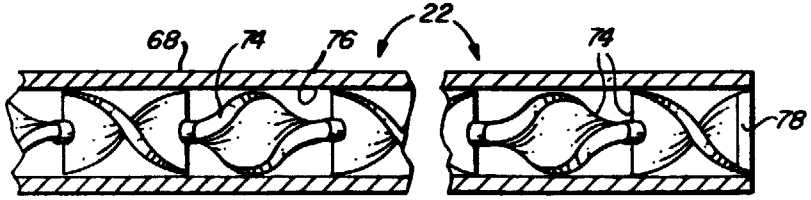
FIG. 4 is a fragmentary sectional view taken along the line 4—4 of FIG. 2.

The static mixer 22 includes an elongated cylindrical housing 68 having its inlet end 63 supportingly passing through the end wall 70 of the materials tank 18 and extending substantially the full length of the materials tank with the housing 68 being suitably supported therein such as by means of the strut bracket assembly 72 shown in FIG. 2. As shown in FIG. 4, and as is known in the art, a static mixer includes an alternating series of right and left hand helical elements 74 fixedly mounted in the bore 76 of the housing 68. Materials being moved under pressure through the static mixer 22 are subjected to dividing and rotational forces due to the helical elements 74 with the degree of mixing being considerably greater than is possible with conventional agitation devices. A static mixer suitable for use in the apparatus 12 is available from the Luwa Corporation, P. O. Box 163,48, Charlotte, N.C., 28216.

In addition to the excellent mixing characteristics of the static mixer 22, another benefit is derived from the use thereof. As is known in the art of mixing asphalt and rubber, the rubber, which is cold when it is deposited into the mixing tank 20, must be elevated to the temperature of the molten asphalt and each particle of the rubber must be brought into contact with the molten asphalt in order for those constituents to react with each other and formed the desired asphalt-rubber composition. In conventional prior art auger type mixing mechanisms, the type required for proper reaction can be quite long. The above described static mixer 22 reduces this reaction time to that taken for movement of the molten-asphalt rubber composition through the mixer. This substantial improvement is believed to result from the divisional and rotational forces imparted by the helical elements 74 which quickly brings all the rubber up to temperature and quickly brings all of the individual rubber particles into contact with the molten asphalt.

As shown, the outlet end 78 of the static mixer 22 opens into the interior of the materials tank 18 and thus, the completely reacted homogeneous asphalt-rubber composition is deposited directly into the materials tank 18. The circulation of the contents of the materials tank 18 through the mixing tank 20 and static mixer 22 is continued until all the desired granulated rubber has been added thereto.

When the mixing has been completed, the asphalt-rubber composition may be continuously recirculated to prevent cooling and solidification of the composition within the valves, pumps and conduits that are external of the materials tank 18 and for proper agitation and temperature control of the composition within the materials tank 18. Such recirculation is employed subsequent to completion of the mixing operational mode and prior to commencement of the asphalt-rubber composition application operational mode.

To place the mixing apparatus 12, and the application vehicle 10 in the application operational mode, the valves 48 and 59 are closed, valve 31 is left closed, and valves 28 and 56 are opened. With the pump 52 operating, the molten asphalt-rubber composition will now be supplied under pressure through the shutoff valve 56 to the conduit 57 which is connected (not shown) to the applicator device 16 of the application vehicle 10. As is the case in the spray bar applicator device 16, and in virtually all applicators, provision is made within the devices for by-passing the molten materials which are being applied thereby. Such by-passing is needed so that temporary interruption of applicator operation is possible and the molten materials will continue to move and thus cooling and solidification within the applicator device will not occur. The by-passing is accomplished by means of the conduit 61, which is coupled (not shown) to the applicator device 16 so that the molten asphalt materials will be recirculated through the device 16 and returned to the materials tank 18 through the conduit 61, pressure valve 62 and the static mixer 22. Further, the amount of materials being supplied to the spray bar 16 is ideally greater than the amount that can be sprayed by the spray bar and the pressure of the supplied materials is greater than is needed for ideal operation. Therefore, excess amounts of the supplied molten material will be returned to the tank 18 via the conduit 61, pressure valve 62 and static mixer 22, and the pressure in the lines leading to and returning from the spray bar 16 is reduced to the ideal pressure by the adjustable pressure valve 62.

Figure 5:
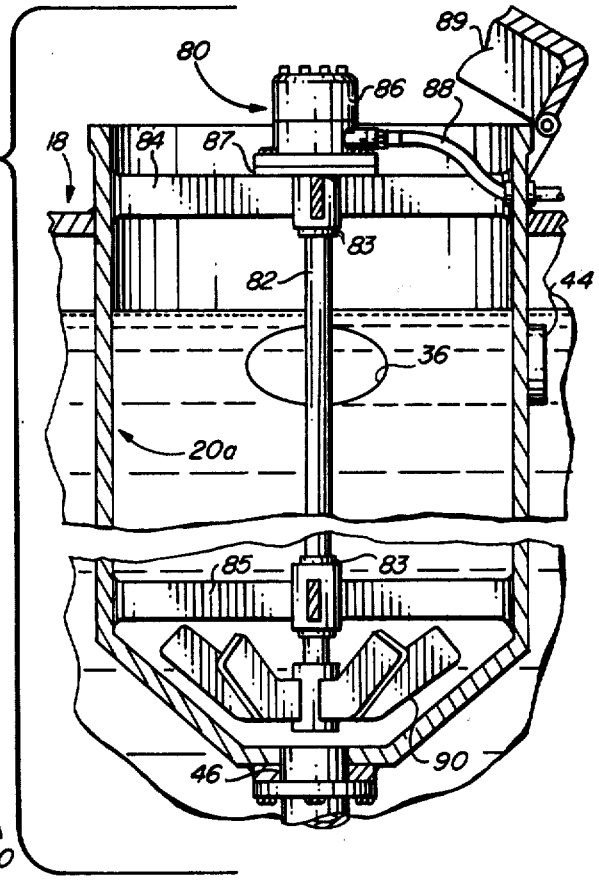
FIG. 5 is a fragmentary sectional view of a portion of the apparatus of the present invention showing a modification thereof.

Referring now to FIG. 5 wherein a modified form of mixing tank 20*a* is shown. The mixing tank 20*a* is mounted in a manner similar to that of the previously described mixing tank 20 and is thus at least partially emersed in the molten asphalt contained in the materials tank. The molten asphalt may be allowed to flow naturally into the mixing tank through the hereinbefore mentioned input conduit 44 and tangential input port 36. It will be understood, however, that the input conduit 39 and pump 38 (FIG. 2) may be employed for directing the molten asphalt into the mixing tank 20*a* if desired. The mixing tank 20*a* is provided with a power driven agitator means 80 to augment the naturally occurring turbulence within the mixing tank 20*a*. The agitator means 80, which may be any of the various well known agitation devices, is shown as including an axially disposed drive shaft 82 which is suitably journaled for rotation in bearings 83 which are mounted in upper and lower support devices 84 and 85, respectively. The upper end of the drive shaft 82 is connected to a drive motor means 86 in the form of, for example, the illustrated hydraulic motor. The hydraulic motor 86 is fixedly mounted on a mounting plate 87 carried on the upper support 84 and has the usual hydraulic fluid hoses 88 which are coupled to a suitable hydraulic pump (not shown) which may be part of the usual equipment provided on the application vehicle 10. The cover 89 of the mixing tank 20*a* is designed with a high crown to accept the motor 86 as shown. A multi-blade agitator 90 is mounted fast on the depending end of the drive shaft 82 for rotation therewith.

It has been found that the mixing tank 20*a*, which utilizes the power driven agitator means 80 to augment the mixing provided by the turbulent flow of the vortex occurring in the tank will provide a satisfactory mixing of the asphalt-rubber composition to the extent that the static mixer 22 may be eliminated. However, the combination of the mixing tank 20 and static mixer 22 is preferred due to the reduced power consumption and better mixing accomplished by that combination.

The mixing apparatus 12, which is hereinbefore discussed as being associated with the spreader truck vehicle 10, may also be associated with other types of pavement composition application vehicles, such as the "crack sealer" fully disclosed in the previously referenced U.S. patent. Among the differences between such vehicles is the physical size of the materials containment tanks. Spreader truck vehicles will, of course, differ in size, but their materials tanks are relatively large and usually have a capacity in the range of 1,000 to 4,500 gallons. Crack sealer machines on the other hand have relatively small materials tanks usually with about a 200 to 400 gallon capacity.

Therefore, placement of a mixing tank 20 or 20*a* in the materials tank 18 of the spreader truck 10 in the manner shown and hereinbefore disclosed will not cause a significant reduction in the capacity of such a tank, in that mixing tank capacity of about 100 to 150 gallons have proven very satisfactory. However, placement of a mixing tank 20 or 20*a* within the relatively small materials tank of a crack sealer vehicle in the manner hereinbefore discussed could seriously reduce the capacity of those relatively smaller tanks.

Figure 6:
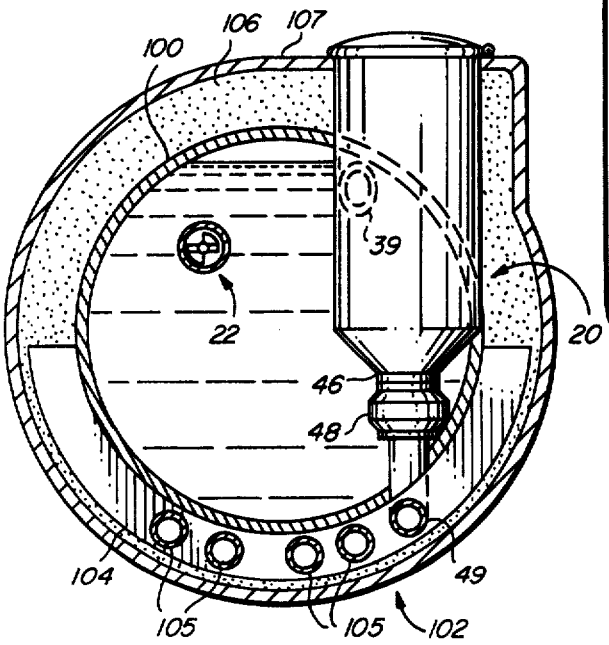
FIG. 6 is a vertical sectional view taken through a second embodiment of the apparatus of the present invention.

Referring now to FIG. 6 which shows a sectional view taken through a materials tank 100 of a crack sealer machine 102 with the mixing tank 20 being shown as being integrally associated therewith. The materials tank 100 is of elongated cylindrical configuration and is provided with a heating jacket 104 which contains a heating oil. The oil is heated by means of suitable heating means (not shown) contained within flues 105 which pass through the jacket. Heat is transferred from the hot oil into the materials tank 100 for proper temperature control of the molten materials contained therein. The materials tank 100 and heating jacket 104 have an insulation blanket 106 wrapped therearound with an outer skin 107. The mixing tank 20 may be mounted in the materials tank 100 so as to be laterally offset from the longitudinal axis of the materials tank within the sidewall portion thereof to minimize the displacement caused by the mixing tank. The mixing tank 20 will still be partially emersed within the molten asphalt contained within the materials tank 100 for temperature transfer and control purposes, and heat losses may be minimized by modifying the usual heating blanket 106 and outer skin 107 of the crack sealer vehicle 102 so that they wrap around the mixing tank. The shutoff valve 48 extends downwardly from the output port 46 of the mixing tank and the conduit 49 exits the materials tank 100 and passes through the heating jacket for connection to the other valves, pumps and conduits (not shown) of the mixing apparatus.

Figure 7:
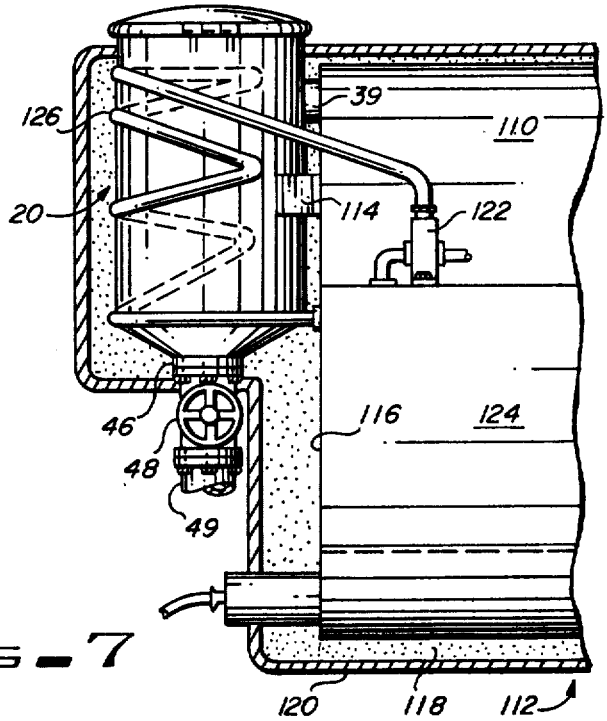
FIG. 7 is a fragmentary sectional view taken through a third embodiment of the apparatus of the present invention.

Another way of accomplishing the same objective is shown in FIG. 7, wherein the materials tank 110 of the crack sealer vehicle 112 is shown as having the mixing tank 20 mounted, such as with a suitable bracket means 114 on one of the end walls 116 of the materials tank. The insulative blanket 118 and outer skin 120 are modified, from the standard configuration normally used on crack sealer machines, so that they wrap around the mixing tank 20 to minimize heat losses. A suitable pump 122 is mounted, for example, on the hot oil containing heating jacket 124 and is suitably driven for extracting hot oil from the heating jacket and directing it through a pipe line 126, which is contiguously wrapped around the mixing tank 20, with the hot oil being recirculatingly returned to the heating jacket. The molten asphalt contained in the materials tank 110 is supplied to the mixing tank 20 in the same manner as hereinbefore described, with the conduit 39 extending through the end wall 116 into the materials tank 110 with the pump 38

(FIG. 2) being suitably mounted within the materials tank. All of the rest of the components of the mixing apparatus, not shown in FIG. 7 but shown best in FIG. 2 and hereinbefore described, are the same in this embodiment as in the embodiments previously disclosed.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications with the limits only of the true spirit and scope of the invention.

What I claim is:

1. Apparatus for mixing an additive with molten paving material and for application of the resultant paving composition comprising:

(a) an application vehicle having a heated materials tank and an applicator means;

(b) means for admitting a quantity of the molten paving material to the interior of said heated materials tank from an external source;

(c) mixing means associated in heat transfer relationship with said heated materials tank and including, I. molten paving material input means for admitting molten paving material from the interior of said materials tank into said mixing means, II. additive input means for admitting the additive from an external source into said mixing means, III. means in said mixing means for mixing the received molten paving material and the additive to produce the resultant paving composition, IV. flow means for causing the received molten paving material and the additive to continuously flow through said mixing means during the mixing thereof and directing the resulting paving composition to the interior of said materials tank; and (d) means coupled between said materials tank and said applicator means for selectively supplying the resultant paving composition thereto.

2. The apparatus of claim 1 wherein said mixing means comprises:

(a) a mixing tank in heat transfer relationship with said heated materials tank and having said additive input means thereon and having said molten paving material input means thereon which includes an inlet port which is tangential with respect to said mixing tank to augment the natural vortex flow therethrough for preliminary mixing of the received molten paving material and the additive; and (b) a static mixer in heat transfer relationship with said materials tank and having an input end which is coupled to receive the preliminary mixture from said mixing tank and complete the mixing to produce the resultant paving composition, said static mixer having its outlet end opening into the interior of said materials tank.

3. The apparatus of claim 2 wherein said flow means comprises a pump interposed between said mixing tank and said static mixer for causing the flow through said mixing tank and directing the preliminary mixture from said mixing tank under pressure to said static mixer.

4. The apparatus of claim 2 wherein said molten paving material input means further comprises:

(a) said tangential inlet port being disposed adjacent the top of said mixing tank but below the full level of the molten paving material receivable in said materials tank; and (b) a conduit extending axially from said inlet port and opening in said materials tank.

5. The apparatus of claim 2 wherein said molten paving material input means further comprises:

(a) an input conduit having one end fixedly attached to said tangential inlet port and having its other end opening into the interior of said materials tank; and (b) a pump in said input conduit for directing the molten paving material receivable in said materials tank under pressure into said mixing tank.

6. The apparatus of claim 2 wherein said additive input means comprises a cover hingedly mounted on the upper end of said mixing tank with said cover being openable to provide access to the interior of said mixing tank.

7. The apparatus of claim 1 wherein said mixing means comprises:

(a) a mixing tank in heat transfer relationship with said materials tank, said mixing tank having said additive input means and said molten paving material input means thereon and having an outlet port; and (b) a power operated agitator means in said mixing tank.

8. The apparatus of claim 7 wherein said molten paving material input means includes an inlet port which is tangentially disposed on said mixing tank to augment the natural vortex flow therethrough for preliminary mixing of the molten paving material and the additive flowable therethrough with the mixing being completed by said power operated agitator means.

9. The apparatus of claim 8 wherein said molten paving material input means further comprises:

(a) said tangential inlet port being disposed adjacent the top of said materials tank but below the full level of the molten paving material receivable in said materials tank; and (b) a conduit extending axially from said inlet port and opening in said materials tank.

10. The apparatus of claim 8 wherein said molten paving material input means further comprises:

(a) an input conduit having one end fixedly attached to said tangential inlet port and having its other end opening into the interior of said materials tank; and (b) a pump in said input conduit for directing the molten paving material receivable in said materials tank under pressure into said mixing tank.

11. The apparatus of claim 7 wherein said additive input means comprises a cover hingedly mounted on said mixing tank with said cover being openable to provide access into the interior of said mixing tank.

12. The apparatus of claim 1 wherein said mixing means further comprises:

(a) an open top mixing tank integral with said heated materials tank with the open top thereof extending upwardly and exteriorly of said heated materials tank with the lower end of said mixing tank extending into the interior of said heated materials tank for at least partial emersion thereof within the molten paving materials receivable in said heated materials tank; and (b) a cover hingedly mounted on the open top of said mixing tank.

13. The apparatus of claim 1 further comprising:

(a) said mixing means including a mixing tank adjacent said heated materials tank; and (b) heat transfer means coupled between said heated materials tank and said mixing tank for transferring heat to said mixing tank.

14. The apparatus of claim 1 wherein said mixing means further includes a static mixer which is at least partially contained within said heated materials tank.

15. Apparatus for mixing granulated rubber with molten asphalt and for application of the resultant asphalt-rubber composition comprising:

(a) an application vehicle having a heated materials tank with means for receiving a quantity of molten asphalt therein from an external source and having an applicator device;

(b) a mixing tank associated in heat transfer relationship with said heated materials tank, said mixing tank having a molten asphalt input port in communication with the molten asphalt receivable in said heated materials tank and having means for admitting granulated rubber to the interior of said mixing tank, said mixing tank having an outlet port;

(c) a static mixer associated in heat transfer relationship with said heated materials tank and coupled to the outlet port of said mixing tank, said static mixer having an outlet end opening into the interior of said materials tank;

(d) a pump interposed between the outlet port of said mixing tank and said static mixer;

(e) said pump cooperating with said mixing tank for moving molten asphalt from said materials tank and the granulated rubber admittable to said mixing tank through said mixing tank in an augmented vortex flow path for preliminary mixing thereof with said pump supplying the preliminary mixture under pressure to said static mixer which completes the mixing and supplies the resultant asphalt-rubber composition to the interior of said materials tank; and (f) means connecting said materials tank and said applicator device for selectively supplying the resultant asphalt-rubber composition from said materials tank to said applicator device.

16. Apparatus for mixing granulated rubber with molten asphalt and for application of the resultant asphalt-rubber composition comprising:

(a) an application vehicle having a heated materials tank with means for receiving a quantity of molten asphalt from an external supply and having an applicator device;

(b) a mixing tank associated in heat transfer relationship with said heated materials tank, said mixing tank having an input port in communication with the molten asphalt receivable in said heated materials tank and having means for admitting granulated rubber from an external supply to the interior of said mixing tank, said mixing tank having an outlet port;

(c) a pump having its inlet coupled to the outlet port of said mixing tank and having its outlet in communication with the interior of said heated materials tank, said pump for moving the molten asphalt from said materials tank and the granulated rubber admittable into said mixing tank through said mixing tank;

(d) power driven agitator means in said mixing tank for mixing the molten asphalt and granulated rubber movable therethrough to produce the resultant asphalt-rubber composition which is supplied by said pump into the interior of said heated materials tank; and (e) means connecting said materials tank and said applicator device for selectively supplying the resultant asphalt-rubber composition from said materials tank to said applicator device.

* * * * *